US010442644B1

(12) United States Patent
Zakharov et al.

(10) Patent No.: US 10,442,644 B1
(45) Date of Patent: Oct. 15, 2019

(54) SYSTEM AND METHOD FOR SHEET CONVEYANCE ANOMALY DETECTION

(71) Applicant: KYOCERA Document Solutions Inc., Osaka-shi, Osaka (JP)

(72) Inventors: Oleg Y. Zakharov, Walnut Creek, CA (US); Yuka Matsukawa, Oakland, CA (US)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/988,415

(22) Filed: May 24, 2018

(51) Int. Cl.
*B65H 7/06* (2006.01)
*B65H 5/06* (2006.01)
*B65H 3/06* (2006.01)

(52) U.S. Cl.
CPC ..... *B65H 7/06* (2013.01); *B65H 3/06* (2013.01); *B65H 5/062* (2013.01)

(58) Field of Classification Search
CPC ... B65H 7/02; B65H 7/06; B65H 7/14; B65H 7/18; B65H 3/06; B65H 5/062; B65H 2511/50; B65H 2511/52; B65H 2513/102; B65H 2513/106
See application file for complete search history.

(56) References Cited

U.S. PATENT DOCUMENTS

2009/0256308 A1* 10/2009 Kazama ..... B65H 7/02 271/226
2016/0251183 A1* 9/2016 Hongo ..... B65H 5/062 271/258.01
2017/0355539 A1* 12/2017 Yoshiwara ..... B65H 3/06

OTHER PUBLICATIONS

Bilinskis, Ivars, "Digital Alias-free Signal Processing," John Wiley & Sons Ltd, ISBN 978-0-470-02738-7, pp. 139-155, May 2007.

* cited by examiner

*Primary Examiner* — David H Bollinger
(74) *Attorney, Agent, or Firm* — Sheppard, Mullin, Richter & Hampton LLP

(57) ABSTRACT

A sheet processing apparatus comprises at least one roller disposed in a sheet conveyance path and configured to convey a plurality of sheets; a sheet sensor disposed in the sheet conveyance path and configured to detect each sheet as it is conveyed by a particular roller of the at least one roller and to generate sensor information indicative of the detection; and a controller configured to: use the sensor information to calculate a sheet passage interval for each sheet; count a first number of times the sheet passage interval is greater than a first threshold corresponding to abnormally slow sheet conveyance and a second number of times the sheet passage interval is lower than a second threshold corresponding to abnormally fast sheet conveyance; determine whether an alert condition has been met based on the counts of the first and second numbers of times; and generate a control signal after the alert condition has been met.

20 Claims, 15 Drawing Sheets

600

| | Time interval (ms) |
|---|---|
| Page 1 | 100 |
| Page 2 | 110 |
| Page 3 | 90 |
| Page N | 600 |

FIG. 6

800

| Page Range | CA2: Below TH2 | CA1: Above TH1 |
|---|---|---|
| P1—P5 | 0 | 0 |
| P6—P9 | 2 | 1 |
| P10—P100 | 8 | 15 |

FIG. 8

SYSTEM AND METHOD FOR SHEET CONVEYANCE ANOMALY DETECTION

BACKGROUND

Copy machines, printers, fax machines, scanners, multifunction devices, and other image forming apparatuses are common devices in business and homes. These image forming apparatuses and other sheet processing apparatuses perform sheet conveyance typically using a plurality of rollers. Each roller contacts and conveys a sheet via friction between the roller and the sheet. Depending on fault conditions, such as defects, roller degradation, low-quality sheets, abnormal temperatures, and so on, sheet conveyance may become excessively slow or fast, which may lead to jams or degradation of image processing (e.g., image forming) on the sheets. For that reason, it is desirable to detect problems early and perform maintenance as soon as possible.

SUMMARY

The following implementations and aspects thereof are described and illustrated in conjunction with systems, tools, and methods that are meant to be exemplary and illustrative, not necessarily limiting in scope. In various implementations one or more of the above-described problems have been addressed, while other implementations are directed to other improvements.

In some embodiments, the present invention provides a sheet processing apparatus comprising at least one roller disposed in a sheet conveyance path and configured to convey a plurality of sheets; a sheet sensor disposed in the sheet conveyance path and configured to detect each sheet of the plurality of sheets as the sheet is conveyed by a particular roller of the at least one roller and to generate sensor information indicative of the detection; and a controller configured to: use the sensor information to calculate a sheet passage interval for each sheet of the plurality of sheets to be conveyed by the particular roller of the at least one roller; count a first number of times the sheet passage interval for each sheet of the plurality of sheets is greater than a first threshold corresponding to abnormally slow sheet conveyance to generate a first threshold count and a second number of times the sheet passage interval for each sheet of the plurality of sheets is lower than a second threshold corresponding to abnormally fast sheet conveyance to generate a second threshold count; determine whether an alert condition has been met based on the first threshold count and the second threshold count; and generate a control signal after the alert condition has been met.

The controller may be configured to generate a first control signal when the first threshold count is greater than the second threshold count, and a second control signal different from the first control signal when the second threshold count is greater than the first threshold count. The control signal may cause generation of a notification to a user. The controller may be configured to count the first number of times and the second number of times during a period of time. The controller may be configured to: count the first number of times and the second number of times during each of a first period of time and a second period of time; compare the first number of times counted during the first period of time with the first number of times counted during the second period of time; compare the second number of times counted during the first period of time with the second number of times counted during the second period of time; and determine whether an alert condition has been met based on the comparisons. The controller may be configured to count the first number of times and the second number of times during which a predetermined number of sheets are being conveyed by the roller. The first threshold or the second threshold may be determined based on a sheet length and rotational rate of the roller. The first threshold or the second threshold may be determined based on an environmental condition. The controller may be configured to compare the first threshold count and the second threshold count with a first alert threshold and a second alert threshold, respectively, to determine whether the alert condition has been met. The first alert threshold or the second alert threshold may be determined based on print/scan quality.

In some embodiments, the present invention provides a method, comprising conveying a plurality of sheets in a sheet conveyance path of a sheet processing apparatus having at least one roller; using a sheet sensor disposed in the sheet conveyance path to detect each sheet of the plurality of sheets as it is conveyed in the sheet conveyance path; calculating a sheet passage interval for each sheet of the plurality of sheets as it passes the sheet sensor; counting a first number of times the sheet passage interval for each sheet of the plurality of sheets is greater than a first threshold corresponding to abnormally slow sheet conveyance to generate a first threshold count and a second number of times the sheet passage interval for each sheet of the plurality of sheets is lower than a second threshold corresponding to abnormally fast sheet conveyance to generate a second threshold count; determining whether an alert condition has been met based on the first threshold count and the second threshold count; and generating a control signal upon the alert condition being met.

The control signal may comprise a first control signal when the first threshold count is greater than the second threshold count, and a second control signal different from the first control signal when the second threshold count is greater than the first threshold count. The method may further comprise initiating a notification to a user in accordance with the control signal. The step of counting the first number of times and the second number of times may include counting the first number of times and the second number of times during a period of time. The step of counting the first number of times and the second number of times may include counting the first number of times and the second number of times during each of a first period of time and a second period of time, and the step of determining whether the alert condition has been met may include: comparing the first number of times counted during the first period of time with the first number of times counted during the second period of time; comparing the second number of times counted during the first period of time with the second number of times counted during the second period of time; and determining whether an alert condition has been met based on the comparisons. The step of counting the first number of times and the second number of times may include counting the first number of times and the second number of times during which a predetermined number of sheets are being conveyed by the roller. The method may further comprise determining the first threshold or the second threshold based on a sheet length and rotational rate of the roller. The method may further comprise determining the first threshold or the second threshold based on print/scan quality. The method may further comprise determining the first threshold or the second threshold based on an environmental condition. The step of determining whether the alert condition has been met includes: comparing the first threshold count and the second threshold count with a first alert threshold and a second alert threshold, respectively; and determining whether an alert condition has been met based on the comparisons. The method may further comprise determining the first alert threshold or the second alert threshold based on print/scan quality.

These and other advantages will become apparent to those skilled in the relevant art upon a reading of the following descriptions and a study of the several examples of the drawings.

BRIEF DESCRIPTION OF THE DRAWINGS

FIG. 6 illustrates a table of an example sheet conveyance interval for individual sheets according to some embodiments.

FIG. 8 illustrates a table of an example number of times a sheet conveyance interval exceeded an upper threshold and a lower threshold for two page ranges according to some embodiments.

DETAILED DESCRIPTION

Some embodiments of the present disclosure are directed at systems and methods for detecting sheet conveyance anomalies in a sheet processing apparatus. Example sheet processing apparatuses include printers, multi-function printers, facsimile machines, copiers, and scanners. In some cases, a sheet is conveyed slower than designed, which may cause sheet collision with a subsequently conveyed sheet. In other cases, a sheet is conveyed faster than designed, which may cause sheet collision with a previously conveyed sheet. A sheet collision may cause a malfunctioning of the sheet processing apparatus such as sheet jams and printing problems, and may demand significant effort to resolve. Accordingly, in some embodiments, a sheet processing apparatus detects abnormal sheet conveyances and evaluate the sheet conveyance anomalies to determine when to notify a user.

In some embodiments, a sheet processing apparatus includes a roller, a sheet sensor, and a controller. The roller is disposed along a sheet conveyance path and configured to convey a sheet. The sheet sensor is disposed on the sheet conveyance path, possibly adjacent to the roller, and is configured to detect the passage interval of the sheet, e.g., the time between the start of the sheet passage and the end of the sheet. In some embodiments, the controller is configured to calculate a sheet passage interval for each of a plurality of sheets, and count a first number of times the sheet passage interval is higher than a first threshold and a second number of times the sheet passage interval is lower than a second threshold, e.g., within a certain duration of time, within a rolling duration of time, within a certain sheet count, within a rolling sheet count, or within some other parameter (time parameter, rolling time parameter, sheet parameter, rolling sheet parameter, etc.). The controller is further configured to evaluate the first and second numbers to determine whether an alert condition has occurred, and to notify a user upon the alert condition being met. The notification may include an email, a text, an alarm, etc., and may include at least one of the counted first number of times and the counted second number of times. By notifying the user of such anomalies, a malfunction may be detected or avoided.

In some embodiments, the controller may compare sheet passage intervals across a number of points in the sheet conveyance path, e.g., at a position adjacent each of the rollers in the path, to determine sheet passage deviations therebetween. Significant deviations between the sheet passage intervals between rollers may also be evidence of an impending jam or device malfunction.

Figure 1A:
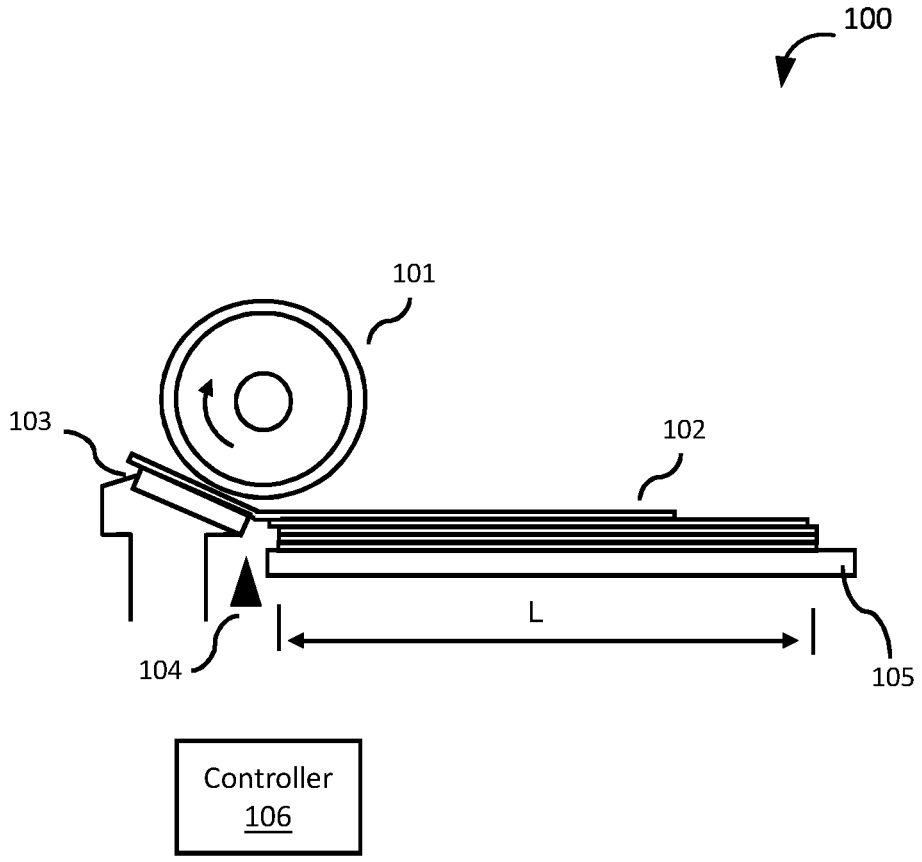
FIG. 1A illustrates a schematic example of a side view of a sheet processing apparatus according to some embodiments.
Figure 1B:
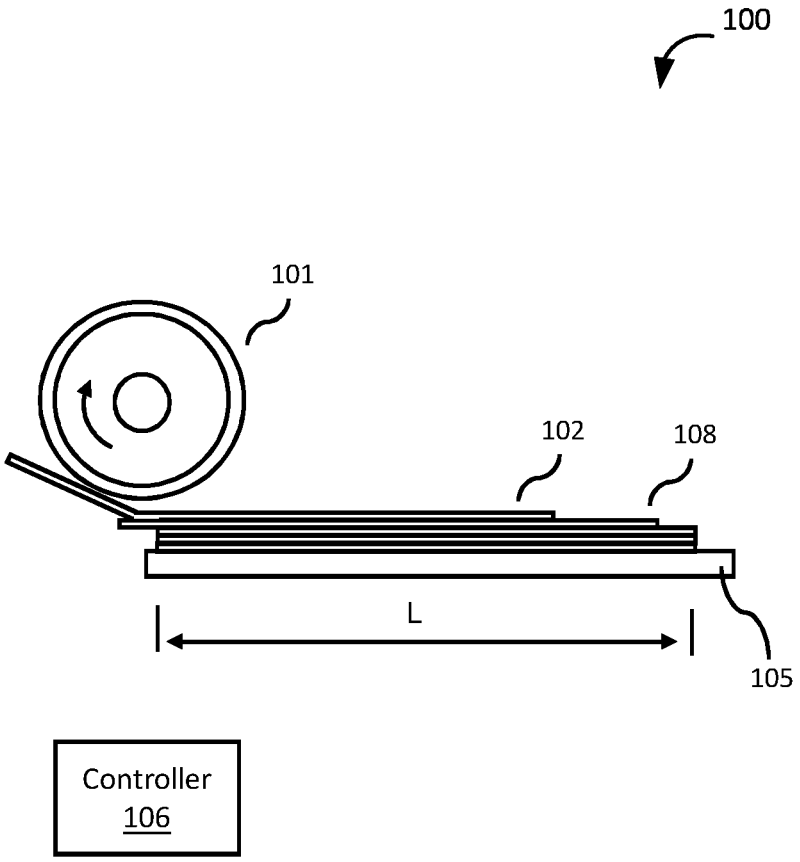
FIG. 1B illustrates a schematic example of a side view of the sheet processing apparatus when multiple sheets are drawn by a sheet feeding roller according to some embodiments.
Figure 1C:
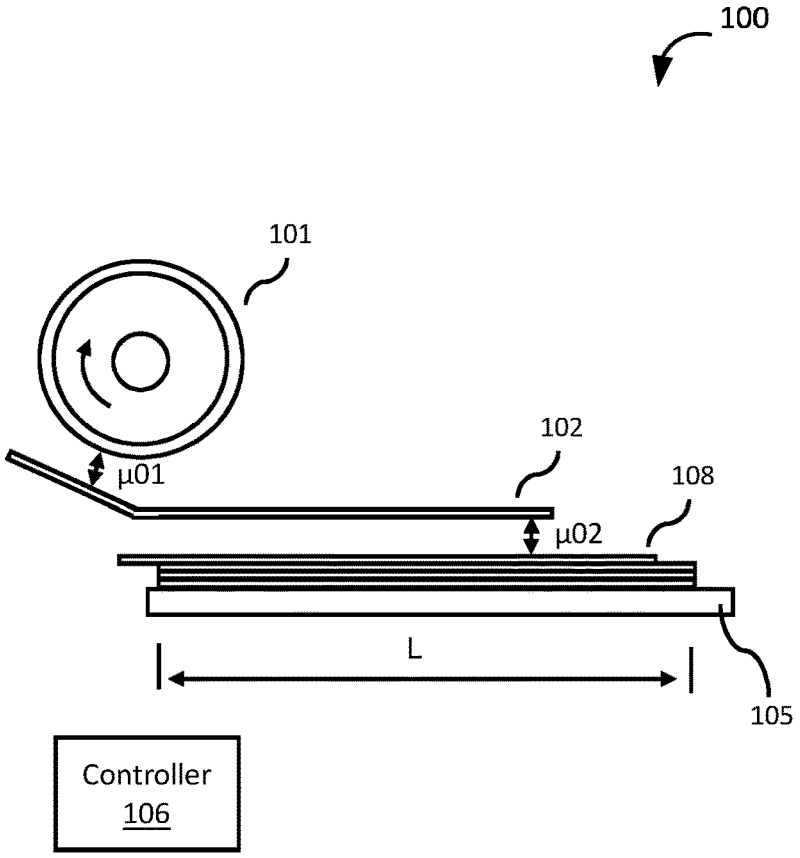
FIG. 1C illustrates a schematic example of a side view of the sheet processing apparatus to explain friction of a sheet with adjacent components according to some embodiments.

FIG. 1A illustrates a schematic example of a side view of a sheet processing apparatus 100 according to some embodiments. FIG. 1B illustrates a schematic example of a side view of the sheet processing apparatus 100 when multiple sheets are drawn by a sheet feeding roller according to some embodiments. FIG. 1C illustrates a schematic example of a side view of the sheet processing apparatus 100 to explain friction of a sheet with adjacent components according to some embodiments. In FIG. 1B and FIG. 1C, several components of the sheet processing apparatus 100 are not depicted to simplify the illustration. In the example, the sheet processing apparatus 100 includes a sheet feeding roller 101, a lifting panel 103, a sensor 104, a sheet holder 105 on which a plurality of sheets 102 is placed, and a controller 106. In some embodiments, the sheet processing apparatus 100 is a sheet feeding device independent of or integrated in an image forming apparatus, such as a printer, a copier, a scanner, a facsimile, a multi-function peripheral (MFP), and so on, and is configured to supply sheets to the sheet processing apparatus 100. In some embodiments, the sheet processing apparatus 100 is a finisher independent of or integrated in the image forming apparatus, configured to receive sheets from the image forming apparatus, and configured to perform sheet processing such as stapling, binding, folding, punching, and so on.

The sheet feeding roller 101 is intended to represent a roller configured to rotate about a rotational axis for conveying sheets 102 placed on the sheet holder 105, one by one. Depending upon a specific implementation and other consideration, a surface of the sheet feeding roller 101 is formed of a material that causes frictional gripping force with a surface of a conveyed sheet. For example, a surface of the sheet feeding roller 101 is formed of rubber, resin, metal, and so on. For example, a surface of the sheet feeding roller 101 has a rugged shape, a smooth shape, a gear shape, and so on. The sheets discussed in the present disclosure include paper (e.g., copier paper), transparent films, cardboard (e.g., post card, business card, etc.), and so on. In some embodiments, the sheet feeding roller 101 is disposed above an end of the sheet holder 105 from which the sheets 102 are conveyed. In some embodiments, the sheet feeding roller 101 is caused to rotate in a sheet conveying direction by a motor or any other applicable actuator, in order to convey the sheets 102. The sheet feeding roller 101 may be configured to rotate at a predetermined rotational speed. In some embodiments, the predetermined rotational speed may differ based on print/scan quality settings or other settings. Rotational speed can be monitored separately from the sheet conveyance interval.

The lifting panel 103 is intended to represent a member configured to guide sheets 102 conveyed by the sheet feeding roller 101 in the sheet conveying direction. The lifting panel 103 is inclined towards an upper direction with respect to a surface of the sheet holder 105 on which the sheets 102 are placed. Depending upon a specific implementation and other consideration, a surface of the lifting panel 103 is formed of applicable materials, such as plastic, resin, metal, a combination thereof, and so on.

The sensor 104 is intended to represent a sensor configured to detect passage of a sheet at the position of the sensor. Depending upon a specific implementation and other consideration, the sensor 104 may employ any applicable technique to detect a sheet passage. For example, the sensor 104 may include an optical sensor configured to detect the start of a sheet and the end of a sheet based on lighting changes caused by the passage of the sheet. In another example, the sensor 104 incudes a mechanical sensor configured to detect the start of a sheet and the end of a sheet based on a mechanical movement of parts caused by the passage of the sheet. In some embodiments, the sensor 104 may be configured to generate a detection signal when a front end of a sheet passes the sensor 104 and a tail end of the sheet passes the sensor 104. In some embodiments, the sensor 104 is disposed at a position adjacent to the sheet feeding roller 101, e.g., immediately before or immediately after the sheet feeding roller 101. In some embodiments, the sensor 104 is disposed above or below the sheet feeding roller 101.

The sheet holder 105 is configured to support the sheets 102 and allow the sheets 102 to be conveyed by the sheet feeding roller 101. Depending on implementation, the sheet holder 105 may be formed of any applicable materials, such as plastic, resin, metal, and combination thereof. In some embodiments, mechanical levers on the sheet holder 105 may be adjustably fixed to support and identify the size in the sheets. The controller 106 may be capable of detecting the size of the sheets in the sheet holder 105 based on the positions of the levers. In some embodiments, sheet size can be determined based on electronic settings. In some embodiments, the sheet holder 105 is configured to move up and down depending on weights of the sheets 102 placed thereon, such that a top sheet is at a position that can be positioned to contact the sheet feeding roller 101 for conveyance.

The controller 106 is a hardware computing device configured to control operations of the sheet processing apparatus 100. In some embodiments, the controller 106 controls rotation of the sheet feeding roller 101 and processes signals generated by and received from the sensor 104. In some embodiments, the controller 106 may control the sheet feeding roller 101 to rotate at a predetermined rotational rate. In some embodiments, the controller 106 is configured to calculate sheet passage intervals based on the detection signals generated by and received from the sensor 104. For example, the controller 106 calculates a sheet passage interval based on a time of a detection signal corresponding to detection of a front end of a sheet and a time of a detection signal corresponding to detection of a tail end of the sheet. In some embodiment, the controller 106 is configured to compare each sheet passage interval against one or more thresholds, to determine whether the sheet has been conveyed by the sheet feeding roller 101 within a trusted time interval. For example, the controller 106 compares a sheet passage interval with a first threshold to determine whether conveyance of the sheet is excessively slow, which may suggest an error in the conveyance of the sheet. In another example, the controller 106 compares a sheet passage interval with a second threshold (lower than the first threshold) to determine whether conveyance of the sheet is excessively fast, which may also suggest a different error in the conveyance of the sheet.

In some embodiments, the controller 106 may be configured to determine deviations of sheet passage intervals of sheets across multiple sensors in the sheet conveyance path of the sheet processing apparatus 100. The controller 106 may detect sheet passage anomalies based on deviations. In some embodiments, sheet conveyance intervals may be expected to be relatively consistent across the sheet conveyance path.

Based on a number or egregiousness of anomalies, e.g., when a sheet passage interval is greater than the first threshold (excessively slow), a friction force between the sheet feeding roller 101 and a top sheet may be insufficient. In a case, when a kinematic friction coefficient $\mu$01 (shown in FIG. 1C) of the friction between the sheet feeding roller 101 and the top sheet is excessively low, the friction force may be insufficient. In a case, anomalies of the kinematic friction coefficient $\mu$01 may be caused by defects of the sheet feeding roller 101, improper quality of sheet (e.g., slippery sheet) may lead to longer sheet passage interval. Similarly, when a sheet passage interval is smaller than the second threshold (excessively fast), the sheet feeding roller 101 may be malfunctioning, a sheet 108 underneath a top sheet may be conveyed together with the top sheet (shown in FIG. 1B), and so on. In a case, when a kinematic friction coefficient $\mu$02 (shown in FIG. 1C) of the friction between the top sheet and the sheet 108 underneath the top sheet is excessively high, the friction force may be excessively high. In a case, anomalies of the kinematic friction coefficient $\mu$02 may be caused by improper quality and/or conditions of sheets (e.g., wet sheets, jammed sheets, etc.) may lead to the companied sheet conveyance.

In some embodiments, notifications may be generated when there is a specific count of anomalies, when an anomaly is significantly outside of the expected range. Anomaly count may be based on the significance of the anomalies, e.g., anomalies may be weighted based on how far outside the trusted range they are, e.g., how many standards of deviation they are outside the trusted range.

In some embodiments, the controller 106 may be configured to differentiate or adjust the first threshold and/or the second threshold based on various applicable criteria. For example, the controller 106 differentiates the first threshold and/or the second threshold based on at least one of sheet type, sheet size (length) in a sheet conveying direction, rotational rate of the sheet feeding roller 101, etc. In some embodiments, the controller 106 may increase the first threshold and/or the second threshold as a surface roughness of sheet (e.g., arithmetical mean deviation) becomes smaller. In some embodiments, the controller 106 may increase the first threshold and/or the second threshold when a length of sheet in the sheet conveying direction is longer. In some embodiments, the controller 106 may increase the first threshold and/or the second threshold as the rotational rate of the sheet feeding roller 101 is slowed. In some embodiments, as image forming quality (e.g., DPI value) becomes higher, the rotational rate of the sheet feeding roller 101 may become slower.

In some embodiments, the controller 106 may differentiate the first threshold and/or the second threshold based on a number of sheet passages within a certain duration of time. The controller 106 may modify the first threshold and/or the second threshold for a first group of sheets (e.g., first several number of sheets) relative to a second group of sheets (e.g., second several number of sheets) passed after the first group of sheets, and/or may modify the first threshold and/or the second threshold for the second group of sheets than the first group of sheets. This differentiation may be based on expectation of greater interval fluctuation as the cumulative number increases.

In another example, the controller 106 differentiates the first threshold and/or the second threshold based on at least one of a geographical region at which the sheet processing apparatus 100 is located, a model of an image processing device (e.g., printing device, scanning device, etc.) incorporating or coupled to the sheet processing apparatus 100, use purpose (e.g., business, home, etc.) of the sheet processing apparatus 100, and recommended values for the sheet processing apparatus 100 determined based on the various applicable criteria. In some embodiments, the controller 106 may increase the first threshold and/or the second threshold as an average humidity of the geographical region (e.g., city, county, etc.) increases. In some embodiments, the controller 106 may increase the first threshold and/or the second threshold based on environmental conditions (e.g., humidity, temperature, UV amount, etc.) of a more specific location at which the sheet processing apparatus 100 is located, such as a building, a floor in a building, a room in a building, and an air conditioning zone in a building.

In some embodiments, the controller 106 may be configured to count the number of times the sheet passage interval is greater than the first threshold (hereinafter "first threshold count") and store the first threshold count in data storage included in or coupled to the controller 106. Similarly, in some embodiments, in processing the detection signals generated by the sensor 104, the controller 106 is configured to count the number of times the sheet passage interval is smaller than the second threshold (hereinafter "second threshold count") and store the second threshold count in data storage included in or coupled to the controller 106. The first threshold count and/or the second threshold count may suggest that a degree of a sheet conveyance anomaly. For example, when the first threshold count is 5, the sheet conveyance anomaly is likely more serious than when the first threshold count is 2. The data storage may have a limited capacity. Since storing the calculated sheet passage intervals for each sheet passage may require a large data capacity, the calculated sheet passage interval may not be stored in the data storage.

In some embodiments, the controller 106 may be configured to count the first threshold count and/or the second threshold count within a parameter. The parameter may be an applicable duration of time. In some implementation, the certain duration of time is a past predetermined period of time sliding according to time passage (e.g., sliding window). For example, the past predetermined period of time may be the past several hours, the past day (24 hour), the past week, the past month, the past 30 days, and so on. In some embodiments, the parameter may be based on usage of the sheet processing apparatus. For example, the parameter may be based on the last predetermined number of sheets (e.g., 300 sheets, 500 sheets, etc.) conveyed by the sheet feeding roller 101. In such case, the controller 106 may be looking for a certain rate of anomalous passage times over a rolling sheet count or a certain number of anomalous passage intervals over a period of time.

In some embodiments, the controller 106 may be configured to determine whether or not the first threshold count and/or the second threshold count meets an alert condition. In some embodiments, an alert condition includes one or more of a condition that the first number of times exceeds a first alert threshold, a condition that the second threshold count exceeds a second alert threshold, and a condition that a sum of the first and second threshold counts exceeds a third alert threshold.

In some embodiments, the controller 106 may be configured to differentiate or adjust the first alert threshold, the second alert threshold, and/or the third alert threshold based on various applicable criteria. For example, the controller 106 may differentiate the first alert threshold, the second alert threshold, and/or the third alert threshold based on an image forming quality (e.g., DPI value) and/or user setting. In a specific implementation, the controller 106 sets one or more of the first, second, and third alert thresholds to be lower as the image forming quality becomes higher.

In another example, the controller 106 differentiates the first alert threshold and/or the second alert threshold based on at least one of the geographical region, the model of the image processing device, the use purpose, and recommended values, in a similar manner as the criteria that can be employed for the first threshold and/or the second threshold described above.

In some embodiments, the controller 106 may be configured to compare the first threshold count and/or the second threshold count obtained at different periods, and determine whether or not an alert condition has been met based on the comparison. For example, the controller 106 compares the first threshold count and/or the second threshold count obtained one day before (past 24 hours) with the first threshold count and/or the second threshold count obtained two days before (past 24-48 hour). In such as case, the alert condition may be that an increased amount of the first threshold count and/or the second threshold count exceeds a predetermined threshold, that an increase rate of the first threshold count and/or the second threshold count exceeds a predetermined threshold. In another example, the controller 106 compares the first threshold counts and/or the second threshold counts obtained past 24 hours at two different time points (e.g., noon and midnight).

In some embodiments, the controller 106 may be configured to generate a control signal upon an alert condition being met. and output a notification upon an alert condition being met. In some embodiments, the control signal causes output of a notification, which may include the first threshold count and/or the second threshold count to be presented to users. For example, when the controller 106 causes the first threshold count and/or the second threshold count to be displayed on a display device included in or coupled to the sheet processing apparatus 100, the controller 106 outputs the first threshold count and/or the second threshold count to the display device. In some embodiments, the notification includes a message to user, which may notify a current state of sheet conveyance, a proposal to perform maintenance, an alert message that image processing may not be properly performed, and so on.

In some embodiments, the control signal causes change of an operational mode of the sheet processing apparatus 100 upon the alert condition being met. In some embodiments, the operational modes includes a normal sheet conveyance mode in which a sheet conveyance is performed normally and an error sheet conveyance mode in which a sheet conveyance may be performed at a reduced sheet conveyance speed with respect to the normal mode or may not be performed.

In some embodiments, the control signal may be differentiated depending on the first threshold count and the second threshold count. For example, the first threshold count is greater than the second threshold count, the controller 106 may generate a first control signal, which may cause generation of a message indicating that the sheet feeding roller 101 needs to be checked. For example, the second threshold count is greater than the first threshold count, the controller 106 may generate a second control signal, which may cause generation of a message indicating that quality and/or conditions of sheets 102 needs to be checked. For example, the first threshold count is equal to the second threshold count, the controller 106 may generate a third control signal, which may cause generation of a message indicating that setting for a rotational rate of the sheet feeding roller 101 and/or placement of the sheets 102 needs to be checked.

Figure 2:
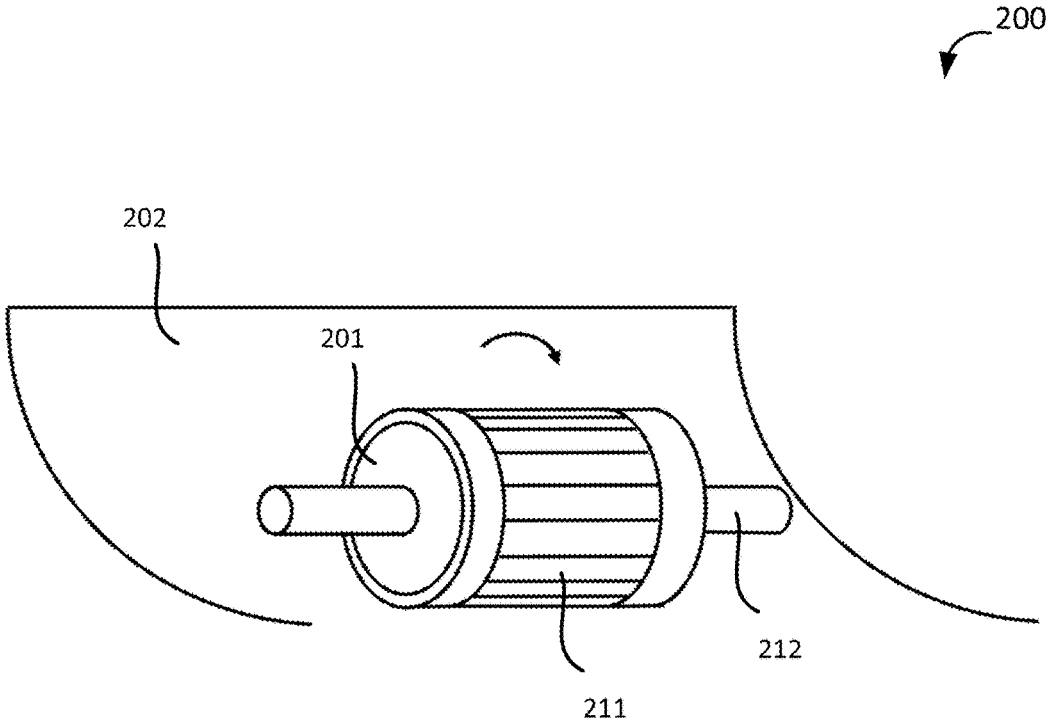
FIG. 2 illustrates a schematic example of a perspective view of a sheet feeding roller according to some embodiments.

FIG. 2 illustrates a schematic example of a perspective view of a sheet feeding apparatus 200 according to some embodiments. In the example of the sheet processing apparatus 200 shown in FIG. 2, a sheet feeding roller 201 includes a sheet contact surface 211 and a rotational axis 212. In some embodiments, the sheet processing roller 201 corresponds to the sheet feeding roller 101 in FIG. 1A.

The sheet contact surface 211 is intended to represent a surface of the sheet feeding apparatus 200 designed to be in contact with a sheet 202 conveyed by the sheet feeding roller 201. In some embodiments, the sheet contact surface 211 has a rugged surface so as to ensure sufficient friction between the sheet contact surface 211 and a surface of the sheet 202. Depending upon a specific implementation and other consideration, the sheet contact surface 211 is formed of applicable materials, such as rubber, resin, metal, combination thereof, and so on.

The rotational axis 212 is intended to represent a member coupled to a main body of the sheet feeding roller 201 including the sheet contact surface 211. In some embodiments, the rotational axis 212 is caused to rotate in a sheet conveying direction by a motor or any applicable actuator (not shown in FIG. 2) provided at an end of the rotational axis 212.

Depending upon a specific implementation and other consideration, when the sheet 202 is not pressed against the sheet contact surface 211 with sufficient force, the sheet 202 may not be properly conveyed or may be conveyed at a speed slower than intended.

Figure 3:
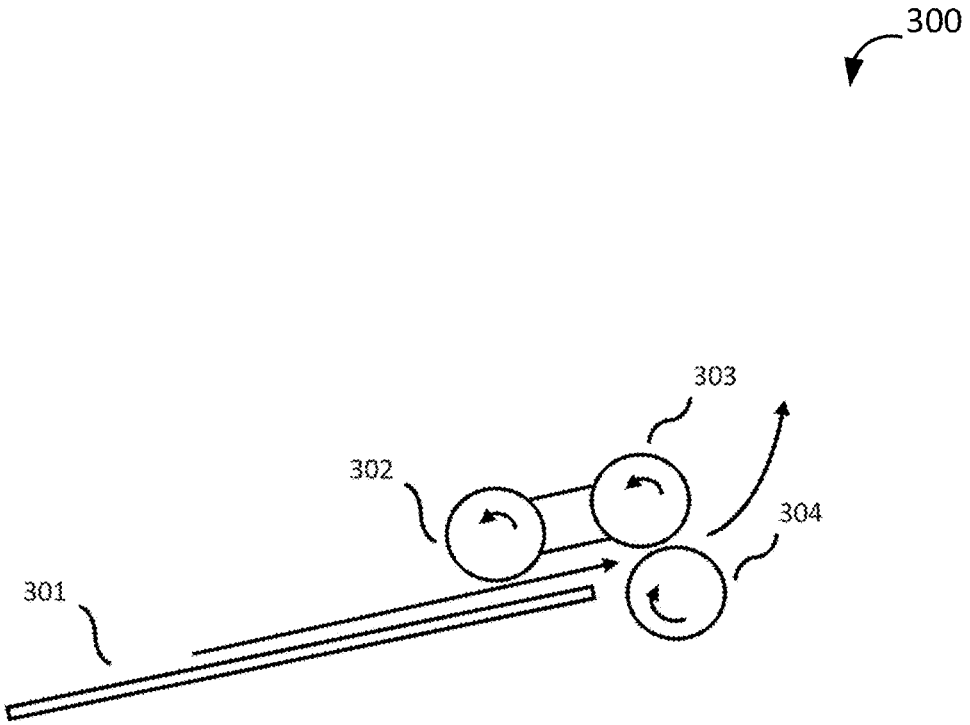
FIG. 3 illustrates a schematic example of a side view of a sheet feeding roller unit according to some embodiments.

FIG. 3 illustrates a schematic example of a side view of a sheet feeding apparatus with a sheet feeding roller unit 300 according to some embodiments.

In the example of the sheet processing apparatus shown in FIG. 3, a sheet feeding roller unit 300 includes a sheet pickup roller 302, a sheet feeding roller 303, and a sheet separation roller 304. In some embodiments, the sheet pickup roller 302 and/or the sheet feeding roller 303 corresponds to the sheet feeding roller 101 in FIG. 1A.

The sheet pickup roller 302 is intended to represent a roller configured to pick up a sheet 301 that comes in contact with the sheet conveyance roller 302. In some embodiments, the sheet pickup roller 302 is positioned above a sheet holder (not shown) so as to be in contact with a top sheet on the sheet holder.

The sheet feeding roller 303 is intended to represent a roller configured to convey a sheet 301 picked up by the sheet pickup roller 302. In some embodiments, a rotational direction of the sheet feeding roller 303 is the same as that of the sheet pickup roller 302. In some embodiments, the sheet pickup roller 302 and the sheet feeding roller 303 are mechanically coupled such that rotations of the sheet pickup roller 302 and the sheet feeding roller 303 coincide. In a specific implementation, conveyance speeds (e.g., radius x rotational rate) of the pickup roller 302 and the sheet feeding roller 303 are the same.

The sheet separation roller 304 is intended to represent a roller configured to separate the top sheet, such that only the top sheet is conveyed by the sheet feeding roller 303. In some embodiments, a rotational rate and/or a conveyance speed of the sheet separation roller 304 may be different (e.g., slower) from a rotational rate and/or a conveyance speed of the sheet feeding roller 303. Also, depending upon a specific implementation and other consideration, a rotational direction of the sheet separation roller 304 may be opposite to the rotational direction of the sheet feeding roller 303.

In some embodiments, a sensor to detect sheet passage (not shown in FIG. 3) may be disposed at any applicable positions of the sheet feeding roller unit. In some embodiments, the sensor may be disposed between the sheet pickup roller 302 and the sheet feeding roller 303. The sensor may be disposed at a position after the sheet feeding roller 303 in the sheet conveyance direction. The sensor may be configured to detect a sheet conveyance anomaly caused by the sheet pickup roller 302, the sheet feeding roller and/or the sheet separation roller 304.

Figure 4:
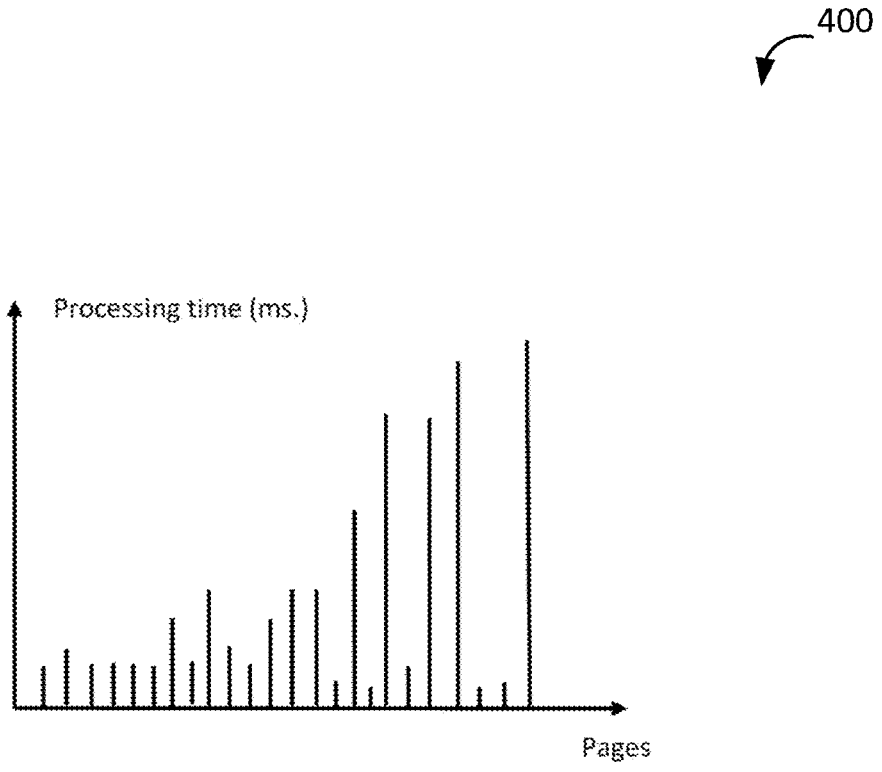
FIG. 4 illustrates a graph of an example sheet passages and sheet conveyance intervals according to some embodiments.

FIG. 4 illustrates a graph 400 of sheet passage relative to sheet conveyance interval according to some embodiments. The vertical axis shown in FIG. 4 indicates a sheet conveyance interval (millisecond), and the horizontal axis indicates a sheet passage that has been performed during a certain duration of time. The graph shown in FIG. 4 is generated from sheet passage signals generated by one sensor disposed in a sheet conveyance path, e.g., a position adjacent to a sheet feeding roller.

As shown in FIG. 4, the fluctuation of the sheet conveyance interval is small the earlier several pages, but is significant for the later pages. This result may be caused by defect and/or degradation of one or more rollers.

Figure 5:
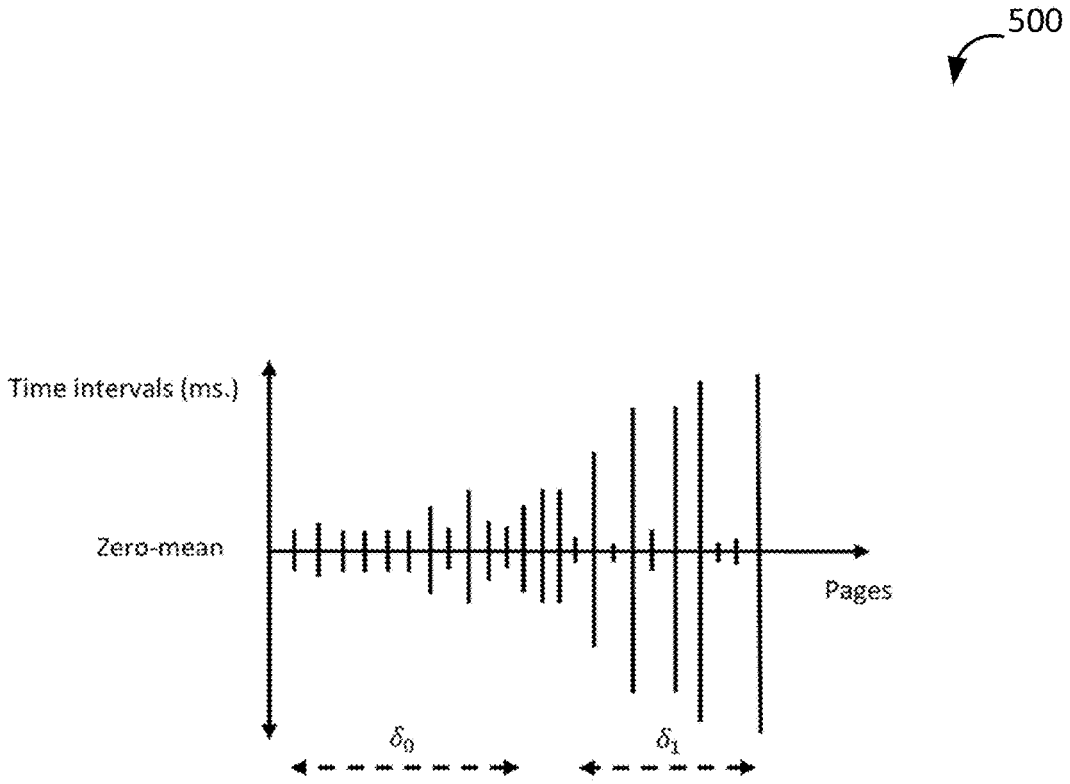
FIG. 5 illustrates a graph of example sheet passages and sheet conveyance intervals relative to an average sheet conveyance interval according to some embodiments.

FIG. 5 illustrates a graph 500 of a sheet conveyance interval shifted relative to an average sheet conveyance interval according to some embodiments. The vertical axis indicates a sheet conveyance interval (millisecond) relative to a zero-mean, and the horizontal axis indicates a sheet passage that has been performed during a certain parameter (duration of time or usage).

As shown in FIG. 5, a fluctuation of the sheet conveyance interval is small for the earlier several pages, but becomes larger for the later pages. As a result, a standard deviation of the sheet conveyance interval for a first group of pages (i.e., 60) is smaller than that for a second group of pages after the first group of pages (i.e., 61). In some embodiments, the standard deviation can be used to determine the first threshold and/or the second threshold. In some embodiments, the standard deviation may be recalculated dynamically for further sheet interval evaluation. In some embodiments, as a standard deviation increases, the first threshold may be increased. As a standard deviation decreases, the second threshold may be decreased. In some embodiments, the thresholds may be static, set by the manufacturer, and/or modified by the user.

FIG. 6 illustrates a chart 600 of example sheet conveyance intervals for N pages according to some embodiments. As shown in FIG. 6, a sheet conveyance interval may become excessively large or small as the number of sheet passages increases. As shown, the sheet conveyance intervals for pages 1, 2, and 3 are within a normal range (e.g., 50-150 ms), and the sheet conveyance interval for page N is outside of the normal range.

Figure 7:
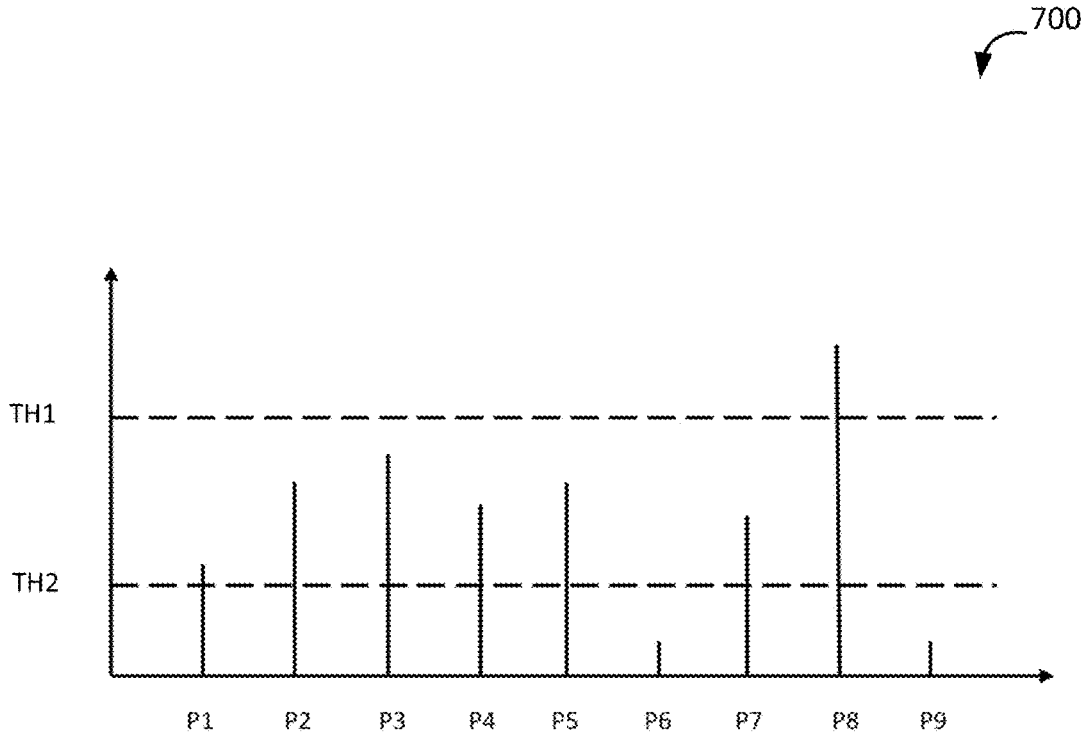
FIG. 7 illustrates a graph of example processing times per page relative to upper and lower thresholds for anomaly detection according to some embodiments.

FIG. 7 illustrates a graph 700 of sheet conveyance intervals relative to the first and second thresholds for anomaly detection according to some embodiments. The vertical axis indicates sheet conveyance interval, and the horizontal axis indicates the sheet passage that has occurred during a certain duration of time or number of sheet passages.

As shown in FIG. 7, two horizontal lines are drawn at TH1 and TH2. The line at TH1 corresponds to the first threshold above which a controller (e.g., the controller 106 in FIG. 1A) counts an anomaly, and the line at TH2 corresponds to a second threshold below which the controller counts an anomaly. In the example of FIGS. 7, P6 and P9 are below the second threshold TH2, and P8 is above the first threshold TH1, respectively.

FIG. 8 illustrates a first threshold count CA1 indicating the number of sheet conveyance intervals that exceeded the upper threshold and a second threshold count CA2 indicating the number of sheet conveyance intervals that were lower than the lower threshold for a time duration, a page range, a number of pages, etc., according to some embodiments. As shown in FIG. 8, the first threshold count CA1 (exceeding the upper threshold TH1) and the second threshold count CA2 (below the lower threshold TH2) are totaled for each of multiple groups of pages (e.g., P1-P5 and P6-P9). The upper threshold and/or the lower threshold may or may not be the same between P1-P5 and P6-P9. As shown, page range P1-P5 had no anomalous passage intervals below the lower threshold TH2 and no anomalous passage intervals above the upper threshold TH1. Page range P6-P9 had two anomalous passage intervals below the lower threshold TH2 and one anomalous passage interval above the upper threshold TH1. Page range P10-P100 had eight anomalous passage intervals below the lower threshold TH2 and fifteen anomalous passage interval above the upper threshold TH1.

In a situation where the second threshold count CA2 is (excessively) greater than the first threshold count CA1 (CA2>CA1), it may suggest that a sheet feeding roller has excessively degraded (worn out) and not that the sheets are in improper quality or condition. In a situation where the first threshold count CA1 is (excessively) greater than the second threshold count CA2 (CA1>CA2), it may suggest that sheets are in improper quality or condition and not that the sheet feeding roller has excessively degraded (worn out). In a situation where the first threshold count CA1 is equal to or roughly equal to (e.g., +/−5%, 10%, 15%) the second threshold count CA2 (CA1≈CA2), it may suggest that the setting of a rotational rate of a sheet feeding roller and/or sheet placement of sheets to be conveyed is improper and needs adjustment.

Figure 9:
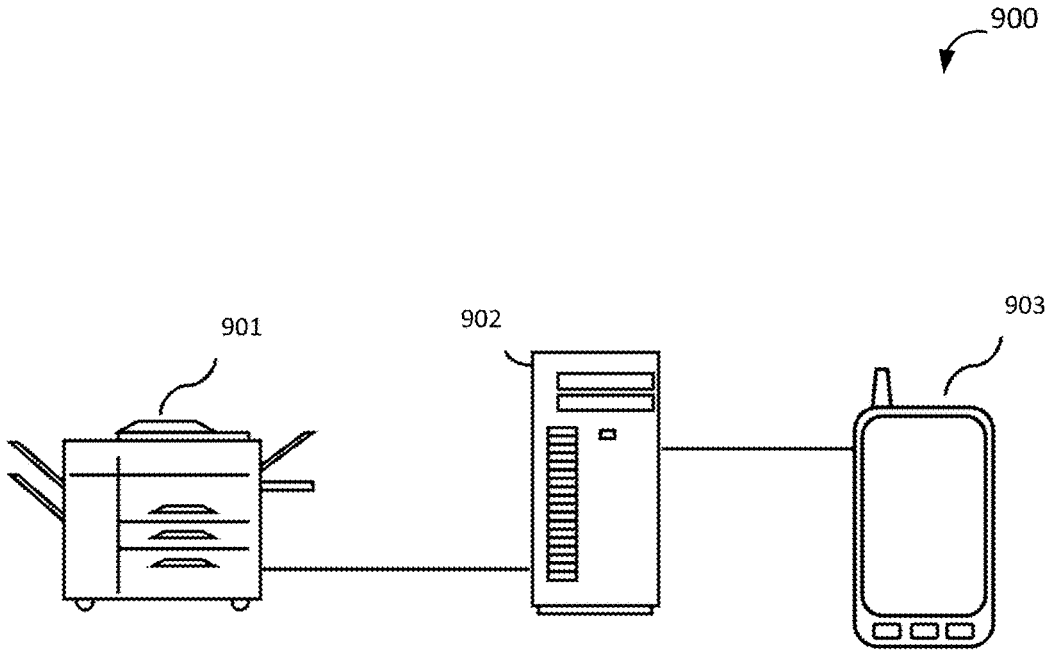
FIG. 9 illustrates an example system for identifying sheet conveyance anomalies according to some embodiments.

FIG. 9 illustrates an example system 900 for determining and notifying sheet conveyance anomalies according to some embodiments. In the example of the system shown in FIG. 9, the system 900 includes an image forming apparatus 901, a server apparatus 902, and/or a mobile computing device 903.

The image forming apparatus 901 is intended to represent an example sheet processing apparatus. The image forming apparatus 901 may perform image forming operations in accordance with any applicable image forming technique, including electrophotographic image forming, inkjet image forming, and so on. In some embodiments, the image forming apparatus 901 includes or is coupled to at least part of a sheet processing apparatus, such as the sheet processing apparatus shown in FIG. 1A. For example, the image forming apparatus 901 includes a sheet feeding roller and a sensor configured to detect sheet passage as in the sheet processing apparatus shown in FIG. 1A. In some examples, the image forming apparatus 901 also includes a controller such as the controller 106 in FIG. 1A.

The server apparatus 902 is intended to represent an apparatus configured to process data regarding sheet conveyance anomalies. In some embodiments, the server apparatus 902 is couplable to the image forming apparatus 901 through a wired and/or wireless connection and configured to receive detection signals generated by a sensor included in the image forming apparatus 901 and process the detection signals. In some embodiments, the server apparatus 902 includes a processing device configured to function as a controller as the controller 106 in FIG. 1A.

The mobile computing device 903 is intended to represent an apparatus configured to receive data regarding sheet conveyance anomalies and present information about sheet conveyance anomalies on a display thereof. In some embodiments, the mobile computing device 903 is couplable to the server apparatus 902 through a wired and/or wireless connection and configured to generate the information about sheet conveyance anomalies based on the data received. In some embodiments, the information about sheet conveyance anomalies may include any applicable information, such as the first and second threshold counts, e.g., the numbers of times a sheet conveyance interval is out of a range (e.g., below and/or above thresholds), a notification of a sheet conveyance anomaly or situation involving a sheet conveyance anomalous situation, a location (e.g., a roller) at which the sheet conveyance anomaly is considered to have happened, a message (e.g., warning, instruction) to perform maintenance, and so on. In addition, any applicable network topology for providing notification of a sheet conveyance anomaly can be employed. For example, the mobile computing device 903 may directly receive data regarding each sheet conveyance anomaly (e.g., detection signals) from the image forming apparatus 901.

Figure 10:
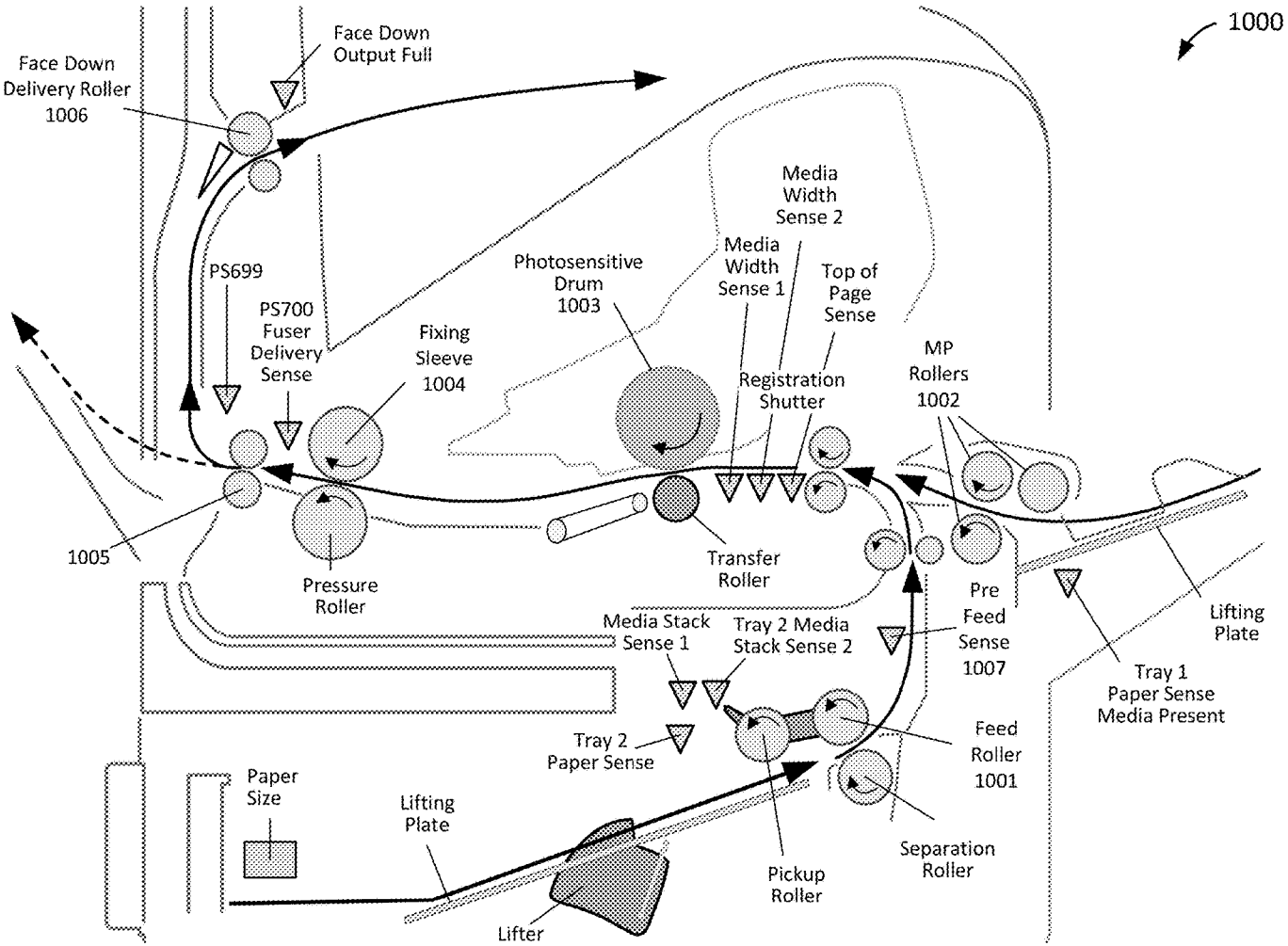
FIG. 10 illustrates an example sheet conveyance path in a sheet conveyance apparatus according to some embodiments.

FIG. 10 illustrates an example sheet conveyance path 1000 in an image forming apparatus according to some embodiments. In the example of the sheet conveyance path 1000 shown in FIG. 10, the image forming apparatus includes a first feed roller 1001, a second feed roller 1002, a photosensitive drum 1003, a fixing roller 1004, a third feed roller 1005, a fourth feed roller 1006, and a plurality of sensors 1007.

The first feed roller 1001 is intended to represent a roller configured to introduce a sheet into the image forming apparatus from a sheet holder disposed at a bottom portion thereof. In some embodiments, the first feed roller 1001 corresponds to the sheet feeding roller 303 in FIG. 3.

The second feed roller 1002 is intended to represent a roller configured to introduce a sheet into the image forming apparatus from a sheet holder (e.g., manual sheet feeder) disposed at a side portion thereof.

The photosensitive drum 1003 is intended to represent a roller configured to transfer a toner image formed thereon onto a sheet passing therethrough. Any known applicable technique can be employed for the structure and configuration of the photosensitive drum 1003.

The fixing roller 1004 is intended to represent a roller configured to fix the tonner image transferred to the sheet at the photosensitive drum 1003 on the sheet, by applying heat. Any known applicable technique can be employed for the structure and configuration of the fixing roller 1004.

The third feed roller 1005 is intended to represent a roller configured to convey a sheet conveyed from the fixing roller 1004. The sheet conveyed by the third feed roller 1005 may be conveyed to a side portion of the image forming apparatus or toward a top portion of the image forming apparatus, depending on sheet processing setting.

The fourth feed roller 1006 is intended to represent a roller configured to convey a sheet conveyed from the third feed roller 1005 to a sheet exit tray formed at the top portion of the image forming apparatus.

Each of the plurality of sensors 1007 is intended to represent a sensor configured to detect passage of a sheet, and is represented by a triangle in FIG. 10. Depending upon a specific implementation and other consideration, one or more of the sensors 1007 corresponds to the sensors 104 in FIG. 1A, and detection signals from the one or more of the sensors 1007 can be used to detect a sheet conveyance anomaly at the position of the one or more of the sensors 1007. In some embodiments, the sheet conveyance anomaly can inform a user of the possibility of a defect in one or more rollers included in the image forming apparatus.

In some embodiments, the controller may compare sheet conveyance intervals at the multiple sensor positions to identify sheet interval deviation that may cause a malfunction (e.g., paper jam or printing error). The positions of a sensor identifying an anomaly may indicate a problem with the roller adjacent the sensor.

Figure 11:
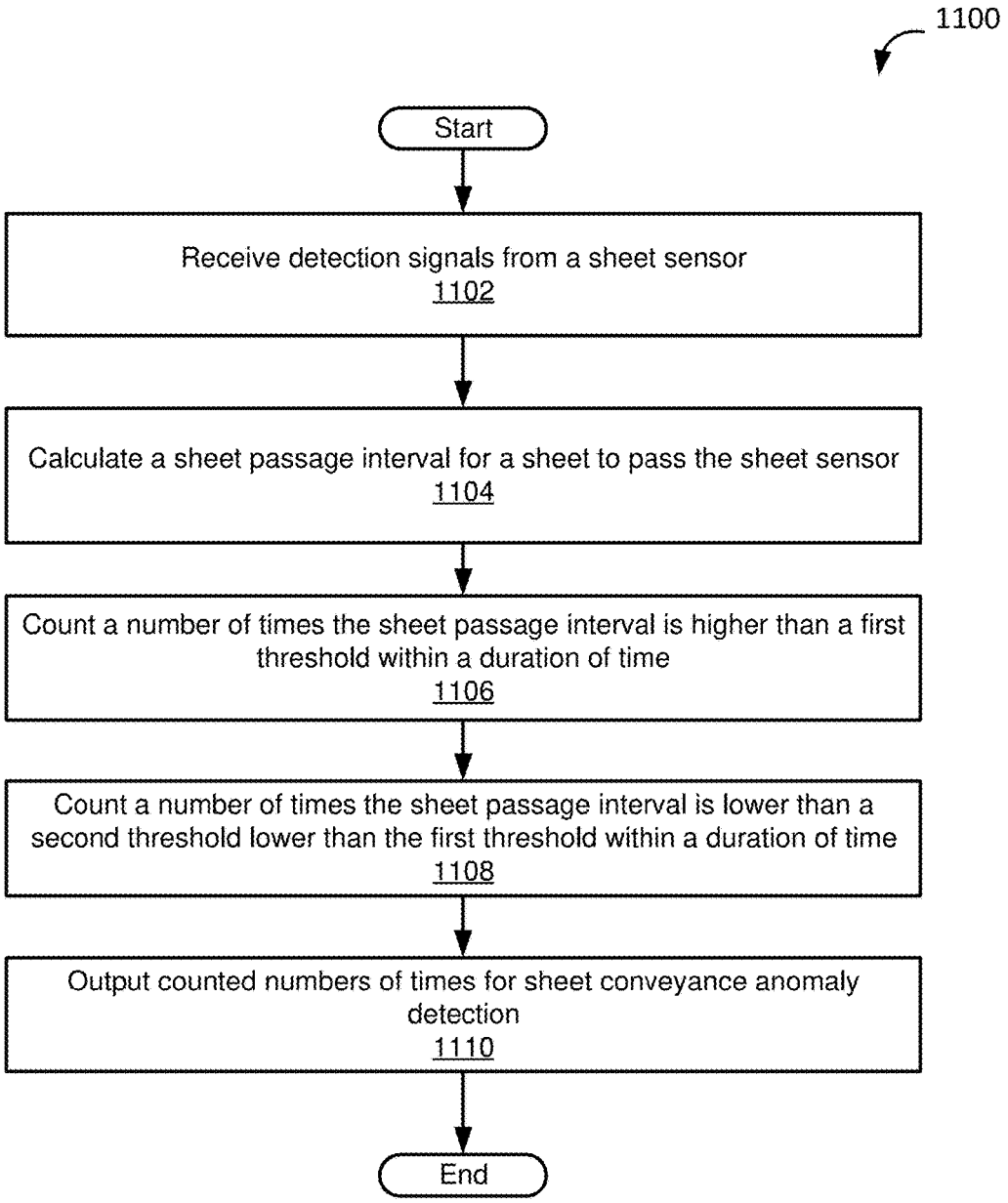
FIG. 11 illustrates a flowchart of an example of a method for operating a sheet processing apparatus according to some embodiments.

FIG. 11 illustrates a flowchart 1100 of an example of a method for operating a sheet processing apparatus. An applicable module for operating a sheet processing apparatus, such as the controller 106 in FIG. 1A, can perform steps of the flowchart 1100. The flowchart 1100 begins at step 1102 with receiving detection signals from a sheet sensor (e.g., the sheet sensor 104 in FIG. 1A). In some embodiments, the detection signals are received when a front end of a sheet passes the sheet sensor and a tail end of the sheet passes the sheet sensor.

The flowchart 1100 continues to step 1104 with calculating a sheet passage interval for the sheet to pass the sheet sensor. In some embodiments, the sheet passage interval is determined based on a time period from the time when a detection signal corresponding to passage of the front end of the sheet is received to the time when a detection signal corresponding to passage of the tail end of the sheet is received. The step 602 and 604 are carried for each of a plurality of sheets.

The flowchart 1100 continues to step 1106 with counting the number of times the sheet passage interval is higher than a first threshold within a certain duration of time or within a predetermined number of sheets. In some embodiments, the first threshold may be determined based on at least one of a type of sheet, a length of sheet in a sheet conveying direction, a rotational rate of a sheet feeding roller, and/or a cumulative number of sheet passages in the duration of time or in the predetermined number of sheets.

The flowchart 1100 continues to step 1108 with counting the number of times the sheet passage interval is lower than the second threshold within the certain duration of time or within a predetermined number of sheets. In some embodiments, the second threshold is lower than the first threshold and may be determined also based on at least one of the type of sheet, the length of sheet in the sheet conveying direction, the rotational rate of the sheet feeding roller, and/or the cumulative number of sheet passages in the duration of time or in the predetermined number of sheets.

The flowchart 1100 continues to step 1110 with outputting the counted numbers of sheet conveyance anomalies in the steps 1106 and 1108. In some embodiments, the counted numbers of sheet conveyance anomalies in the steps 1106 and 1108 are output to any applicable devices including a display coupled to or integrated with the sheet processing apparatus, a server apparatus for distribution to user devices such as a mobile phone, and/or the user device. A notification may be generated when an alert condition is satisfied, the alert condition being based on the count of anomalies exceeding the first threshold, below the second threshold, and/or deviating from others in the sheet conveyance path. Other factors may also be part of the notification condition.

Figure 12:
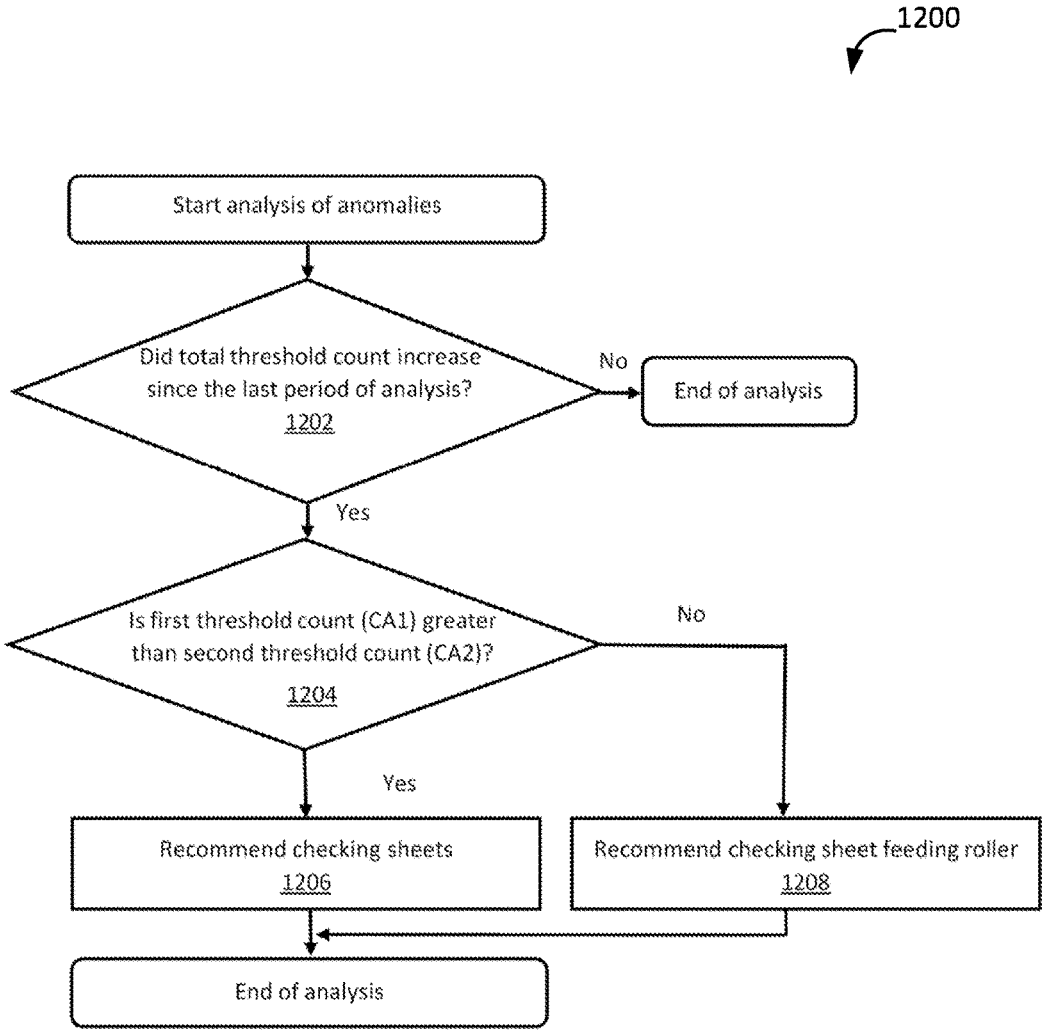
FIG. 12 illustrates a flowchart of another example of a method for operating a sheet processing apparatus according to some embodiments.

FIG. 12 illustrates a flowchart 1200 of another example a method for operating a sheet processing apparatus according to some embodiments. An applicable module for operating a sheet processing apparatus, such as the controller 106 in FIG. 1A, can perform steps of the flowchart 1200. The flowchart 1200 begins at step 1202 with determining whether a total threshold count, which is a sum of a first threshold count (e.g., CA1 in FIG. 8) and a second threshold count (CA2 in FIG. 8), increased since the last analysis of sheet conveyance anomaly. In some embodiments, the analysis of sheet conveyance anomaly is carried out at applicable timing, such as every predetermined duration of time or in response to a triggering event, such as a user command, an excessive increase rate of a threshold count, detection of sheet jam, detection of sheet conveyance anomaly, and so on. When it is determined that the total threshold count has not increased (No in step 1202), the flowchart 1200 ends.

When it is determined that the total threshold count increased (Yes in step 1202), the flowchart 1200 continues to step 1204 with determining whether the first threshold count is greater than the second threshold count.

When it is determined that the first threshold count is greater than the second threshold count (Yes in step 1204), the flowchart 1200 continues to step 1206 with generating a control signal causing a first message recommending checking sheets, and ends the analysis. In some embodiments, the first message may specify the type of sheets to be used, orientation of the sheets, conditions of the sheets, and so on.

When it is determined that the first threshold count is not greater than the second threshold count (No in step 1204), the flowchart 1200 continues to step 1208 with generating a control signal causing a second message recommending checking sheet feeding rollers, and ends the analysis. In some embodiments, the second message may specify the type of sheets to be used, orientation of the sheets, conditions of the sheets, and so on.

Hardware Implementation

The techniques described herein can be implemented using one or more special-purpose computing devices. The special-purpose computing devices may be hard-wired to perform the techniques, or may include circuitry or digital electronic devices such as one or more application-specific integrated circuits (ASICs) or field programmable gate arrays (FPGAs) that are persistently programmed to perform the techniques, or may include one or more hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, server computer systems, portable computer systems, handheld devices, networking devices or any other device or combination of devices that incorporate hard-wired and/or program logic to implement the techniques.

Computing device(s) are generally controlled and coordinated by operating system software, such as iOS, Android, Chrome OS, Windows XP, Windows Vista, Windows 7, Windows 8, Windows 10, Windows Server, Windows CE, Unix, Linux, SunOS, Solaris, iOS, Blackberry OS, VxWorks, or other compatible operating systems. In other embodiments, the computing device may be controlled by a proprietary operating system. Conventional operating systems control and schedule computer processes for execution, perform memory management, provide file system, networking, I/O services, and provide a user interface functionality, such as a graphical user interface ("GUI"), among other things.

Figure 13:
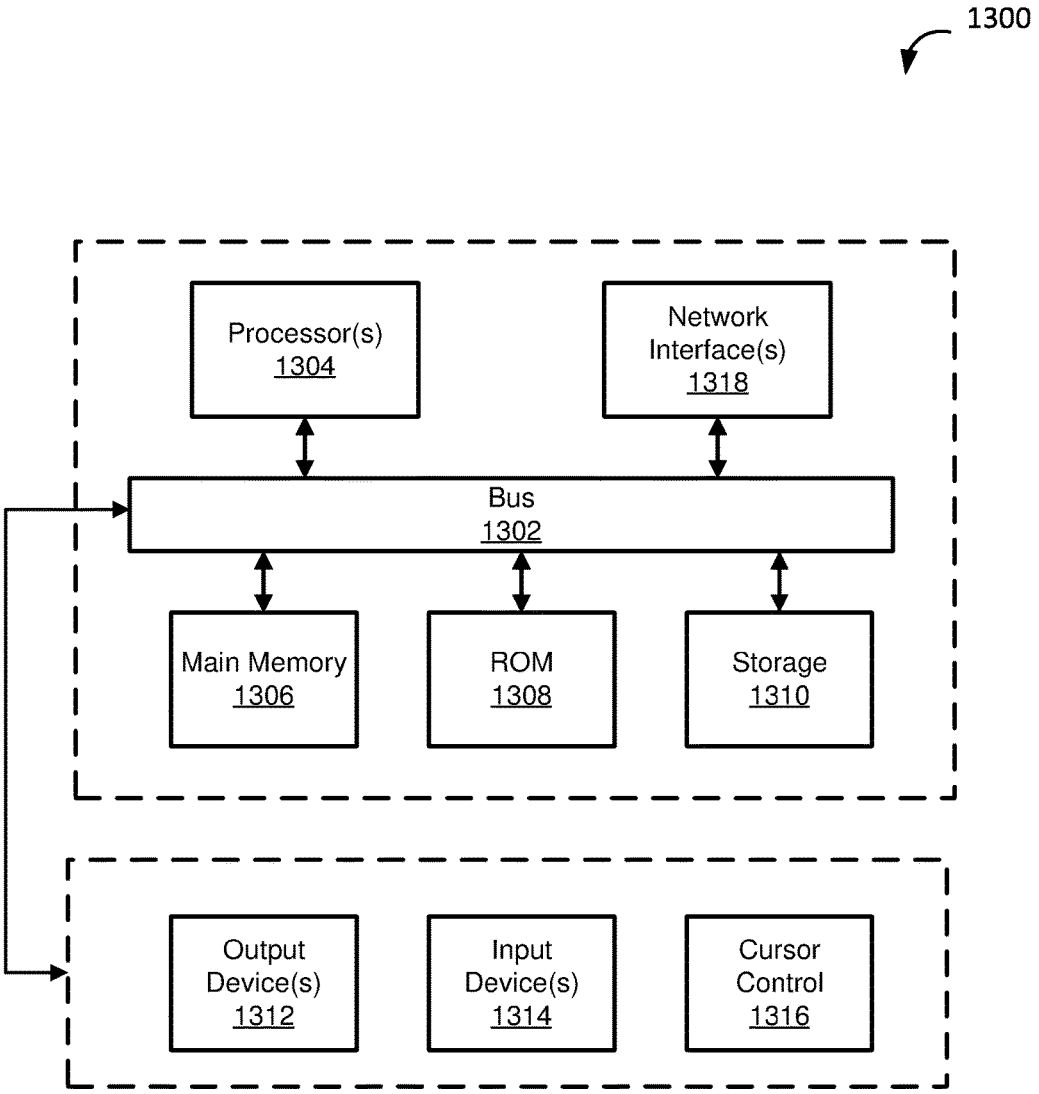
FIG. 13 illustrates a block diagram of an example computer system upon which the various embodiments described herein may be implemented.

FIG. 13 illustrates a block diagram that illustrates a computer system 1300 upon which computer-based processing involved in embodiments described herein may be implemented. In some embodiments, the computer system 1300 can be employed as the controller 106 in FIG. 1A, a main control module of the image forming apparatus 901, a main control module of the server apparatus 902, and/or a main control module of the mobile computing device 903 in FIG. 9. The computer system 1300 includes a bus 1302 or other communication mechanism for communicating information, one or more hardware processors 1304 coupled with bus 1302 for processing information. Hardware processor(s) 1304 may be, for example, one or more general purpose microprocessors.

The computer system 1300 also includes a main memory 1306, such as a random access memory (RAM), cache and/or other dynamic storage devices, coupled to bus 1302 for storing information and instructions to be executed by processor 1304. Main memory 1306 also may be used for storing temporary variables or other intermediate information during execution of instructions to be executed by processor 1304. Such instructions, when stored in storage media accessible to processor 1304, render computer system 1300 into a special-purpose machine that is customized to perform the operations specified in the instructions.

The computer system 1300 further includes a read only memory (ROM) 1308 or other static storage device coupled to bus 1302 for storing static information and instructions for processor 1304. A storage device 1310, such as a magnetic disk, optical disk, or USB thumb drive (Flash drive), etc., is provided and coupled to bus 1302 for storing information and instructions.

The computer system 1300 may be coupled via bus 1302 to a display 1312, such as a cathode ray tube (CRT) or LCD display (or touch screen), for displaying information to a computer user. An input device 1314, including alphanumeric and other keys, is coupled to bus 1302 for communicating information and command selections to processor 1304. Another type of user input device is cursor control 1316, such as a mouse, a trackball, or cursor direction keys for communicating direction information and command selections to processor 1304 and for controlling cursor movement on display 1312. This input device typically has two degrees of freedom in two axes, a first axis (e.g., x) and a second axis (e.g., y), that allows the device to specify positions in a plane. In some embodiments, the same direction information and command selections as cursor control may be implemented via receiving touches on a touch screen without a cursor.

The computing system 1300 may include a user interface module to implement a GUI that may be stored in a mass storage device as executable software codes that are executed by the computing device(s). This and other modules may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables.

In general, the word "module," as used herein, refers to logic embodied in hardware or firmware, or to a collection of software instructions, possibly having entry and exit points, written in a programming language, such as, for example, Java, C or C++. A software module may be compiled and linked into an executable program, installed in a dynamic link library, or may be written in an interpreted programming language such as, for example, BASIC, Perl, or Python. It will be appreciated that software modules may be callable from other modules or from themselves, and/or may be invoked in response to detected events or interrupts. Software modules configured for execution on computing devices may be provided on a computer readable medium, such as a compact disc, digital video disc, flash drive, magnetic disc, or any other tangible medium, or as a digital download (and may be originally stored in a compressed or installable format that requires installation, decompression or decryption prior to execution). Such software code may be stored, partially or fully, on a memory device of the executing computing device, for execution by the computing device. Software instructions may be embedded in firmware, such as an EPROM. It will be further appreciated that hardware modules may be comprised of connected logic units, such as gates and flip-flops, and/or may be comprised of programmable units, such as programmable gate arrays or processors. The modules or computing device functionality described herein are preferably implemented as software modules, but may be represented in hardware or firmware. Generally, the modules described herein refer to logical modules that may be combined with other modules or divided into sub-modules despite their physical organization or storage.

The computer system 1300 may implement the techniques described herein using customized hard-wired logic, one or more ASICs or FPGAs, firmware and/or program logic which in combination with the computer system causes or programs computer system 1300 to be a special-purpose machine. According to one embodiment, the techniques herein are performed by computer system 1300 in response to processor(s) 1304 executing one or more sequences of one or more instructions contained in main memory 1306. Such instructions may be read into main memory 1306 from another storage medium, such as storage device 1310. Execution of the sequences of instructions contained in main memory 1306 causes processor(s) 1304 to perform the process steps described herein. In alternative embodiments, hard-wired circuitry may be used in place of or in combination with software instructions.

The term "non-transitory media," and similar terms, as used herein refers to any media that store data and/or instructions that cause a machine to operate in a specific fashion. Such non-transitory media may comprise non-volatile media and/or volatile media. Non-volatile media includes, for example, optical or magnetic disks, such as storage device 1310. Volatile media includes dynamic memory, such as main memory 1306. Common forms of non-transitory media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge, and networked versions of the same.

Non-transitory media is distinct from but may be used in conjunction with transmission media. Transmission media participates in transferring information between non-transitory media. For example, transmission media includes coaxial cables, copper wire and fiber optics, including the wires that comprise bus 1302. Transmission media can also take the form of acoustic or light waves, such as those generated during radio-wave and infra-red data communications.

Various forms of media may be involved in carrying one or more sequences of one or more instructions to processor 1304 for execution. For example, the instructions may initially be carried on a magnetic disk or solid state drive of a remote computer. The remote computer can load the instructions into its dynamic memory and send the instructions over a telephone line using a modem. A modem local to computer system 1300 can receive the data on the telephone line and use an infra-red transmitter to convert the data to an infra-red signal. An infra-red detector can receive the data carried in the infra-red signal and appropriate circuitry can place the data on bus 1302. Bus 1302 carries the data to main memory 1306, from which processor 1304 retrieves and executes the instructions. The instructions received by main memory 1306 may retrieves and executes the instructions. The instructions received by main memory 1306 may optionally be stored on storage device 1310 either before or after execution by processor 1304.

The computer system 1300 also includes a network interface 1318 coupled to bus 1302. Network interface 1318 provides a two-way data communication coupling to one or more network links that are connected to one or more local networks. For example, network interface 1318 may be an integrated services digital network (ISDN) card, cable modem, satellite modem, or a modem to provide a data communication connection to a corresponding type of telephone line. As another example, network interface 1318 may be a local area network (LAN) card to provide a data communication connection to a compatible LAN (or WAN component to communicated with a WAN). Wireless links may also be implemented. In any such implementation, network interface 1318 sends and receives electrical, electromagnetic or optical signals that carry digital data streams representing various types of information.

A network link typically provides data communication through one or more networks to other data devices. For example, a network link may provide a connection through local network to a host computer or to data equipment operated by an Internet Service Provider (ISP). The ISP in turn provides data communication services through the world wide packet data communication network now commonly referred to as the "Internet". Local network and Internet both use electrical, electromagnetic or optical signals that carry digital data streams. The signals through the various networks and the signals on network link and through communication interface 1318, which carry the digital data to and from computer system 1300, are example forms of transmission media.

The computer system 1300 can send messages and receive data, including program code, through the network(s), network link and network interface 1318. In the Internet example, a server might transmit a requested code for an application program through the Internet, the ISP, the local network and the network interface 1318.

The received code may be executed by processor 1304 as it is received, and/or stored in storage device 1310, or other non-volatile storage for later execution.

Each of the processes, methods, and algorithms described in the preceding sections may be embodied in, and fully or partially automated by, code modules executed by one or more computer systems or computer processors comprising computer hardware. The processes and algorithms may be implemented partially or wholly in application-specific circuitry.

The various features and processes described above may be used independently of one another, or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

Conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Any process descriptions, elements, or blocks in the flow diagrams described herein and/or depicted in the attached figures should be understood as potentially representing modules, segments, or portions of code which include one or more executable instructions for implementing specific logical functions or steps in the process. Alternate implementations are included within the scope of the embodiments described herein in which elements or functions may be deleted, executed out of order from that shown or discussed, including substantially concurrently or in reverse order, depending on the functionality involved, as would be understood by those skilled in the art.

It should be emphasized that many variations and modifications may be made to the above-described embodiments, the elements of which are to be understood as being among other acceptable examples. All such modifications and variations are intended to be included herein within the scope of this disclosure. The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

Engines, Components, and Logic

Certain embodiments are described herein as including logic or a number of components, engines, or mechanisms. Engines may constitute either software engines (e.g., code embodied on a machine-readable medium) or hardware engines. A "hardware engine" is a tangible unit capable of performing certain operations and may be configured or arranged in a certain physical manner. In various example embodiments, one or more computer systems (e.g., a standalone computer system, a client computer system, or a server computer system) or one or more hardware engines of a computer system (e.g., a processor or a group of processors) may be configured by software (e.g., an application or application portion) as a hardware engine that operates to perform certain operations as described herein.

In some embodiments, a hardware engine may be implemented mechanically, electronically, or any suitable combination thereof. For example, a hardware engine may include dedicated circuitry or logic that is permanently configured to perform certain operations. For example, a hardware engine may be a special-purpose processor, such as a Field-Programmable Gate Array (FPGA) or an Application Specific Integrated Circuit (ASIC). A hardware engine may also include programmable logic or circuitry that is temporarily configured by software to perform certain operations. For example, a hardware engine may include software executed by a general-purpose processor or other programmable processor. Once configured by such software, hardware engines become specific machines (or specific components of a machine) uniquely tailored to perform the configured functions and are no longer general-purpose processors. It will be appreciated that the decision to implement a hardware engine mechanically, in dedicated and permanently configured circuitry, or in temporarily configured circuitry (e.g., configured by software) may be driven by cost and time considerations.

Accordingly, the phrase "hardware engine" should be understood to encompass a tangible entity, be that an entity that is physically constructed, permanently configured (e.g., hardwired), or temporarily configured (e.g., programmed) to operate in a certain manner or to perform certain operations described herein. As used herein, "hardware-implemented engine" refers to a hardware engine. Considering embodiments in which hardware engines are temporarily configured (e.g., programmed), each of the hardware engines need not be configured or instantiated at any one instance in time. For example, where a hardware engine comprises a general-purpose processor configured by software to become a special-purpose processor, the general-purpose processor may be configured as respectively different special-purpose processors (e.g., comprising different hardware engines) at different times. Software accordingly configures a particular processor or processors, for example, to constitute a particular hardware engine at one instance of time and to constitute a different hardware engine at a different instance of time.

Hardware engines can provide information to, and receive information from, other hardware engines. Accordingly, the described hardware engines may be regarded as being communicatively coupled. Where multiple hardware engines exist contemporaneously, communications may be achieved through signal transmission (e.g., over appropriate circuits and buses) between or among two or more of the hardware engines. In embodiments in which multiple hardware engines are configured or instantiated at different times, communications between such hardware engines may be achieved, for example, through the storage and retrieval of information in memory structures to which the multiple hardware engines have access. For example, one hardware engine may perform an operation and store the output of that operation in a memory device to which it is communicatively coupled. A further hardware engine may then, at a later time, access the memory device to retrieve and process the stored output. Hardware engines may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented engines that operate to perform one or more operations or functions described herein. As used herein, "processor-implemented engine" refers to a hardware engine implemented using one or more processors.

Similarly, the methods described herein may be at least partially processor-implemented, with a particular processor or processors being an example of hardware. For example, at least some of the operations of a method may be performed by one or more processors or processor-implemented engines. Moreover, the one or more processors may also operate to support performance of the relevant operations in a "cloud computing" environment or as a "software as a service" (SaaS). For example, at least some of the operations may be performed by a group of computers (as examples of machines including processors), with these operations being accessible via a network (e.g., the Internet) and via one or more appropriate interfaces (e.g., an Application Program Interface (API)).

The performance of certain of the operations may be distributed among the processors, not only residing within a single machine, but deployed across a number of machines. In some example embodiments, the processors or processor-implemented engines may be located in a single geographic location (e.g., within a home environment, an office environment, or a server farm). In other example embodiments, the processors or processor-implemented engines may be distributed across a number of geographic locations.

Language

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Although an overview of the subject matter has been described with reference to specific example embodiments, various modifications and changes may be made to these embodiments without departing from the broader scope of embodiments of the present disclosure. Such embodiments of the subject matter may be referred to herein, individually or collectively, by the term "invention" merely for convenience and without intending to voluntarily limit the scope of this application to any single disclosure or concept if more than one is, in fact, disclosed.

The embodiments illustrated herein are described in sufficient detail to enable those skilled in the art to practice the teachings disclosed. Other embodiments may be used and derived therefrom, such that structural and logical substitutions and changes may be made without departing from the scope of this disclosure. The Detailed Description, therefore, is not to be taken in a limiting sense, and the scope of various embodiments is defined only by the appended claims, along with the full range of equivalents to which such claims are entitled.

It will be appreciated that an "engine," "system," "data store," and/or "database" may comprise software, hardware, firmware, and/or circuitry. In one example, one or more software programs comprising instructions capable of being executable by a processor may perform one or more of the functions of the engines, data stores, databases, or systems described herein. In another example, circuitry may perform the same or similar functions. Alternative embodiments may comprise more, less, or functionally equivalent engines, systems, data stores, or databases, and still be within the scope of present embodiments. For example, the functionality of the various systems, engines, data stores, and/or databases may be combined or divided differently.

"Open source" software is defined herein to be source code that allows distribution as source code as well as compiled form, with a well-publicized and indexed means of obtaining the source, optionally with a license that allows modifications and derived works.

The data stores described herein may be any suitable structure (e.g., an active database, a relational database, a self-referential database, a table, a matrix, an array, a flat file, a documented-oriented storage system, a non-relational No-SQL system, and the like), and may be cloud-based or otherwise.

As used herein, the term "or" may be construed in either an inclusive or exclusive sense. Moreover, plural instances may be provided for resources, operations, or structures described herein as a single instance. Additionally, boundaries between various resources, operations, engines, engines, and data stores are somewhat arbitrary, and particular operations are illustrated in a context of specific illustrative configurations. Other allocations of functionality are envisioned and may fall within a scope of various embodiments of the present disclosure. In general, structures and functionality presented as separate resources in the example configurations may be implemented as a combined structure or resource. Similarly, structures and functionality presented as a single resource may be implemented as separate resources. These and other variations, modifications, additions, and improvements fall within a scope of embodiments of the present disclosure as represented by the appended claims. The specification and drawings are, accordingly, to be regarded in an illustrative rather than a restrictive sense.

Although the invention has been described in detail for the purpose of illustration based on what is currently considered to be the most practical and preferred implementations, it is to be understood that such detail is solely for that purpose and that the invention is not limited to the disclosed implementations, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A sheet processing apparatus comprising:

at least one roller disposed in a sheet conveyance path and configured to convey a plurality of sheets;

a sheet sensor disposed in the sheet conveyance path and configured to detect each sheet of the plurality of sheets as the sheet is conveyed by a particular roller of the at least one roller and to generate sensor information indicative of the detection; and a controller configured to:

use the sensor information to calculate a sheet passage interval for each sheet of the plurality of sheets as the sheet is conveyed by the particular roller of the at least one roller;

count a first number of times the sheet passage interval is greater than a first threshold corresponding to an abnormally slow sheet conveyance to generate a first threshold count, and a second number of times the sheet passage interval is lower than a second threshold corresponding to an abnormally fast sheet conveyance to generate a second threshold count;

determine whether an alert condition has been met, the alert condition being in accordance with the first threshold count and the second threshold count; and generate a control signal after the alert condition has been met, the control signal for causing an alert to be provided to a user.

2. The sheet processing apparatus of claim 1, wherein the controller is configured to generate a first control signal when the first threshold count is greater than the second threshold count, and a second control signal different from the first control signal when the second threshold count is greater than the first threshold count.

3. The sheet processing apparatus of claim 1, wherein the control signal causes generation of a notification to be transmitted to the user.

4. The sheet processing apparatus of claim 1, wherein the controller is configured to count the first number of times and the second number of times during a period of time.

5. The sheet processing apparatus of claim 1, wherein the controller is configured to:

count the first number of times and the second number of times during each of a first period of time and a second period of time;

compare the first number of times counted during the first period of time with the first number of times counted during the second period of time;

compare the second number of times counted during the first period of time with the second number of times counted during the second period of time; and determine whether the alert condition has been met based on the comparisons.

6. The sheet processing apparatus of claim 1, wherein the controller is configured to count the first number of times and the second number of times during which a predetermined number of sheets are being conveyed by the at least one roller.

7. The sheet processing apparatus of claim 1, wherein the first threshold or the second threshold is determined based on a sheet length and a rotational rate of the roller.

8. The sheet processing apparatus of claim 1, wherein the first threshold or the second threshold is determined based on an environmental condition.

9. The sheet processing apparatus of claim 1, wherein the controller is configured to compare the first threshold count and the second threshold count with a first alert threshold and a second alert threshold, respectively, to determine whether the alert condition has been met.

10. The sheet processing apparatus of claim 9, wherein the first alert threshold or the second alert threshold is determined based on print/scan quality.

11. A method, comprising:

conveying a plurality of sheets in a sheet conveyance path of a sheet processing apparatus having at least one roller;

using a sheet sensor disposed in the sheet conveyance path to detect each sheet of the plurality of sheets as the sheet is conveyed in the sheet conveyance path by a particular roller of the at least one roller and to generate sensor information indicative of the detection;

using the sensor information to calculate a sheet passage interval for each sheet of the plurality of sheets as the sheet is conveyed by the particular roller of the at least one roller;

counting a first number of times the sheet passage interval is greater than a first threshold corresponding an abnormally slow sheet conveyance to generate a first threshold count, and a second number of times the sheet passage interval is lower than a second threshold corresponding an abnormally fast sheet conveyance to generate a second threshold count;

determining whether an alert condition has been met, the alert condition being in accordance with the first threshold count and the second threshold count; and generating a control signal after the alert condition has been met, the control signal for causing an alert to be provided to a user.

12. The method of claim 11, wherein the control signal comprises a first control signal when the first threshold count is greater than the second threshold count, and comprises a second control signal different from the first control signal when the second threshold count is greater than the first threshold count.

13. The method of claim 11, further comprising initiating transmission of a notification to the user in accordance with the control signal.

14. The method of claim 11, wherein the counting the first number of times and the second number of times includes counting the first number of times and the second number of times during a period of time.

15. The method of claim 11, wherein the counting the first number of times and the second number of times includes counting the first number of times and the second number of times during each of a first period of time and a second period of time, and the determining whether the alert condition has been met includes:

comparing the first number of times counted during the first period of time with the first number of times counted during the second period of time;

comparing the second number of times counted during the first period of time with the second number of times counted during the second period of time; and determining whether the alert condition has been met based on the comparisons.

16. The method of claim 11, wherein the counting the first number of times and the second number of times includes counting the first number of times and the second number of times during which a predetermined number of sheets are being conveyed by the at least one roller.

17. The method of claim 11, further comprising determining the first threshold or the second threshold based on a sheet length and a rotational rate of the roller.

18. The method of claim 11, further comprising determining the first threshold or the second threshold based on an environmental condition.

19. The method of claim 11, wherein the determining whether the alert condition has been met includes:

comparing the first threshold count and the second threshold count with a first alert threshold and a second alert threshold, respectively; and determining whether the alert condition has been met based on the comparison of the first threshold count with the first alert threshold and the comparison of the second threshold count with the second alert threshold.

20. The method of claim 19, further comprising determining the first alert threshold or the second alert threshold based on print/scan quality.

* * * * *